US010138034B2

(12) United States Patent
Brown et al.

(10) Patent No.: US 10,138,034 B2
(45) Date of Patent: Nov. 27, 2018

(54) SINGULAR CAP COMPOUND VENTED NURSING AND RELATED BOTTLE

(71) Applicants: Craig E Brown, Chesterfield, MO (US); Robert J Brown, Chesterfield, MO (US)

(72) Inventors: Craig E Brown, Chesterfield, MO (US); Robert J Brown, Chesterfield, MO (US)

( * ) Notice: Subject to any disclaimer, the term of this patent is extended or adjusted under 35 U.S.C. 154(b) by 0 days.

(21) Appl. No.: 14/999,549

(22) Filed: May 23, 2016

(65) Prior Publication Data

US 2016/0296422 A1 Oct. 13, 2016

Related U.S. Application Data

(63) Continuation-in-part of application No. 14/120,758, filed on Jun. 24, 2014, which is a continuation of application No. 13/065,411, filed on Mar. 22, 2011, now abandoned, and a continuation-in-part of application No. 12/321,455, filed on Jan. 21, 2009, now Pat. No. 8,113,365.

(60) Provisional application No. 61/340,993, filed on Mar. 25, 2010, provisional application No. 61/062,754, filed on Jan. 29, 2008.

(51) Int. Cl.

| | |
|---|---|
| ***B65D 47/32*** | (2006.01) |
| ***A61J 11/02*** | (2006.01) |
| *A61J 11/04* | (2006.01) |

(52) U.S. Cl.

CPC ..... *B65D 47/32* (2013.01); *A61J 11/02* (2013.01); *A61J 11/04* (2013.01)

(58) Field of Classification Search

CPC ..... A47G 19/2266; A61J 11/02; A61J 11/04; B65D 47/32

USPC ..... 222/188, 478

See application file for complete search history.

(56) References Cited

U.S. PATENT DOCUMENTS

| | | | | |
|---|---|---|---|---|
| 189,691 | A * | 4/1877 | Briere | A61J 9/04 215/11.5 |
| 345,518 | A * | 7/1886 | Lelievre | A61J 9/00 215/11.1 |
| 598,231 | A * | 2/1898 | Roderick | A61J 9/04 215/11.5 |
| 679,144 | A * | 7/1901 | Hardesty | G01F 19/00 222/184 |

(Continued)

*Primary Examiner* — Patrick M Buechner
*Assistant Examiner* — Michael J Melaragno
(74) *Attorney, Agent, or Firm* — Paul M. Denk

(57) ABSTRACT

A vent prevents a vacuum from forming within an inverted container of liquid when the liquid is dispensed. The vent is a double vent, formed of a vent tube, upon which a reservoir and its integral vent tube locate, the reservoir securing with the vent tube that extends through the reservoir upper surface, to achieve the double venting of the interior of the container. The container is a nursing bottle, with a collar and nipple applied to the top, and the vent tube being integrally formed extending downwardly from the collar, and securing the reservoir and its integral tube thereon, when assembled for usage. The bottle may be formed of a transparent material, tinted to one coloration, while the reservoir and its reservoir tube may be tinted to a different coloration, which when they are assembled, exhibits a third coloration for the reservoir tube when viewed from exteriorly of the tinted nursing bottle during its application.

8 Claims, 4 Drawing Sheets

(56) References Cited

U.S. PATENT DOCUMENTS 834,014 A * 10/1906 Lyke ..... B65D 1/06 215/11.5
880,669 A * 3/1908 Keller ..... B65D 47/32 222/481.5
927,013 A * 7/1909 Van Cleave ..... A61J 9/04 215/11.5
979,607 A * 12/1910 Van Cleave ..... A61J 9/04 215/11.5
1,190,586 A * 7/1916 Robertson ..... B65D 47/32 222/481.5
1,441,623 A * 1/1923 Davenport ..... A61J 9/04 137/533.11
1,600,804 A * 9/1926 Donaldson ..... A61J 9/04 215/11.1
2,061,477 A * 11/1936 Perry ..... A61J 9/006 215/11.5
2,133,411 A * 10/1938 Zohe ..... A61J 9/001 215/11.1
2,156,313 A * 5/1939 Schwab ..... A61J 1/05 206/438
2,156,314 A * 5/1939 Schwab ..... A61L 2/26 137/588
2,196,323 A * 4/1940 Norton ..... A61J 1/05 215/399
2,239,275 A * 4/1941 Schwab ..... B65D 47/18 137/588
2,248,127 A * 7/1941 Schwab ..... B65D 47/32 137/588
2,500,199 A * 3/1950 Nesset ..... A61M 5/162 137/559
2,610,755 A * 9/1952 Gits ..... A61J 9/008 215/11.5
2,742,168 A * 4/1956 Panetti ..... A61J 9/00 215/11.4
2,744,646 A * 5/1956 Blackstone ..... A61J 11/0055 215/11.1
2,996,207 A * 8/1961 Witz ..... A61J 9/008 215/11.1
3,059,797 A * 10/1962 Wilkinson ..... A61J 9/00 215/11.1
3,071,272 A * 1/1963 Byron ..... A61J 7/0023 215/11.1
3,168,221 A * 2/1965 Parker ..... B65D 47/06 222/109
3,254,809 A * 6/1966 Breneman ..... A61J 7/0046 222/442
3,467,270 A * 9/1969 Eady ..... A61J 1/1418 137/846
3,630,419 A * 12/1971 Pierce ..... B65D 47/32 222/478
3,813,223 A * 5/1974 Fleck ..... B01L 3/50825 422/550
4,080,989 A * 3/1978 Chapelsky ..... B65D 47/06 137/588
4,091,965 A * 5/1978 Gebhard ..... A61J 7/0023 222/192
4,120,414 A * 10/1978 Harrison ..... B65D 51/1611 215/307
4,182,460 A * 1/1980 Holk, Jr. ..... B65D 17/163 220/271
4,838,464 A * 6/1989 Briggs ..... B65D 23/00 215/382
4,966,300 A * 10/1990 Coonradt ..... A47G 19/2266 215/229
4,967,922 A * 11/1990 Alder ..... B65D 47/32 215/309
5,054,660 A * 10/1991 Sherman ..... G01F 11/262 222/454
5,232,110 A * 8/1993 Purnell ..... B65D 47/06 215/309
5,265,769 A * 11/1993 Wilson ..... A47G 19/2266 222/175
5,269,444 A * 12/1993 Wright ..... B01F 3/04446 222/190
5,284,262 A * 2/1994 O'Nan ..... B65D 55/145 215/206
5,305,928 A * 4/1994 Verdaguer ..... B65D 51/246 141/18
5,439,125 A * 8/1995 Bloch ..... A47G 19/2266 215/11.1
5,449,098 A * 9/1995 Offman ..... B67D 3/0019 222/481.5
5,509,551 A * 4/1996 Terrell, II ..... A47G 19/2266 215/229
5,570,796 A * 11/1996 Brown ..... A61J 9/04 215/11.1
5,678,710 A * 10/1997 Sheu ..... A61J 11/02 215/11.1
5,682,931 A * 11/1997 Mouchmouchian .. A61J 7/0023 141/18
5,747,083 A * 5/1998 Raymond ..... A61J 11/002 215/11.3
5,779,071 A * 7/1998 Brown ..... A61J 9/006 215/11.1
5,961,008 A * 10/1999 Peckels ..... B65D 39/06 222/477
5,964,382 A * 10/1999 Randal ..... B65D 51/1611 222/478
6,276,559 B1 * 8/2001 DeMars ..... A47G 19/2266 215/229
6,499,615 B1 * 12/2002 Szieff ..... A61J 9/00 215/11.1
6,607,092 B2 * 8/2003 Manganiello ..... A47G 19/2272 220/714
7,395,949 B2 * 7/2008 Ehret ..... B67D 1/045 215/231
7,537,128 B2 * 5/2009 Nachumi ..... A61J 9/006 215/11.1
7,806,303 B1 * 10/2010 Hastings ..... B65D 47/243 222/481.5
7,828,165 B2 * 11/2010 Brown ..... A61J 9/006 215/11.4
7,984,818 B1 * 7/2011 Fucito ..... A61J 9/04 215/11.1
8,011,540 B1 * 9/2011 Peckels ..... B01F 3/04099 222/190
8,020,303 B1 * 9/2011 Marsh ..... A47G 21/004 222/192
8,113,365 B2 * 2/2012 Brown ..... A61J 9/04 215/11.1
2004/0050883 A1 * 3/2004 Wagner, III ..... B65D 47/32 222/484
2005/0184026 A1 * 8/2005 Haley ..... B65D 47/06 215/306
2005/0184075 A1 * 8/2005 Belcastro ..... A47G 19/2272 220/714
2005/0236353 A1 * 10/2005 Hsu ..... A61J 9/006 215/11.5
2005/0258124 A1 * 11/2005 Brown ..... A61J 9/006 215/11.1
2005/0284835 A1 * 12/2005 McKendry ..... A47J 41/0077 215/11.1
2006/0076362 A1 * 4/2006 Masuda ..... B65D 47/30 222/107
2006/0108378 A1 * 5/2006 Cohen ..... A61F 9/0008 222/211
2006/0201902 A1 * 9/2006 Brown ..... A47G 19/2272 215/11.4
2006/0243694 A1 * 11/2006 McKendry ..... A47J 41/0061 215/11.1
2008/0099422 A1 * 5/2008 Rees ..... A61J 9/006 215/11.5
2009/0194030 A1 * 8/2009 Liang ..... A01K 9/005 119/71
2009/0200257 A1 * 8/2009 McKendry ..... A61J 9/04 215/11.5
2009/0302073 A1 * 12/2009 McKeown ..... A47K 5/122 222/571

(56) References Cited

U.S. PATENT DOCUMENTS

| | | | | |
|---|---|---|---|---|
| 2010/0032398 | A1* | 2/2010 | Struckmeier | A61J 9/04<br>215/11.5 |
| 2010/0133221 | A1* | 6/2010 | Levis | A61J 9/00<br>215/11.1 |
| 2010/0258593 | A1* | 10/2010 | Laible | B65D 47/283<br>222/478 |
| 2011/0233236 | A1* | 9/2011 | Brown | A47G 19/2266<br>222/481 |
| 2014/0190922 | A1* | 7/2014 | Rhodes | A61J 11/02<br>215/11.5 |

* cited by examiner

SINGULAR CAP COMPOUND VENTED NURSING AND RELATED BOTTLE

CROSS REFERENCE TO RELATED APPLICATION

This is a non-provisional patent application of the continuation-in-part patent application having Ser. No. 62/230,082, filed on Jun. 27, 2015, which claims priority to the patent application pending in the United States Patent Office under Ser. No. 14/120,758, filed on Jun. 24, 2014, which application is a continuation of the non-provisional patent application having Ser. No. 13/065,411, filed on Mar. 22, 2011, and which claims priority upon the provisional application having Ser. No. 61/340,993, filed on Mar. 25, 2010; which previous non-provisional application claims priority to the pending non-provisional application having Ser. No. 12/321,455, filed on Jan. 21, 2009, and which claims priority to its provisional application having Ser. No. 61/062,754, filed on Jan. 29, 2008.

FIELD OF THE INVENTION

This invention relates to a vent that prevents the creation of a vacuum inside of a container, particularly a nursing bottle, which includes venting structure assembled from very few components for furnishing a double venting of such a bottle, and because of the few components involved, they are easy to disassemble, clean, and reassemble for immediate usage in the feeding of formula to the infant. Also, the invention relates to a variable color design for a nursing and other bottle.

BACKGROUND OF THE INVENTION

The applicants herein have a history of designing vented containers, particularly nursing bottles, and have obtained significant commercial success in the marketing of these products. In particular, the essence of their invention is to provide for a double venting of a container, particularly a nursing bottle, so that when a liquid is consumed, from therein, it is free of aeration or bubbles, does not require sucking by the infant when drinking from the nursing bottle, and furthermore, contains reduced parts that can be easily cleaned, during application and usage.

The concept of this current invention is to even reduce further the number of parts required to attain a compound venting when consuming liquids from a container, and particularly a nursing bottle, when used for feeding infants and small children.

Prior art containers, other than the applicants' prior inventions and patents, that hold and pour liquids have the disadvantage of usually leaking, introducing air into the liquid, not pouring on demand, not venting the container, and not providing a balanced pressure inside the container, so that little sucking or negative pressure is required to withdraw the liquids from their containers. In addition, many of the prior art utilize either direct venting, which means that any fluids located within the vent tube will pour freely from the container, in which the vent structure is installed, only to create a mess for the infant if it is drinking from a nursing bottle, containing such early venting structure.

Frequently, in order to lessen leakage, many prior art vents require a particular orientation of the container, generally in an upward position, and such can be seen in the prior Parker U.S. Pat. No. 3,168,221, upon a vent means for bottles and jugs. If the vent therein is not oriented correctly, a significant amount of liquid is spilled from the vent to the outside of the container, and typically onto the user of the container, particularly if it is an infant consuming a formula.

As stated, the applicants have successfully designed a venting system that alleviates the leakage problem as previously referred to, through the use of a double venting structure, as can be noted in their U.S. Pat. No. 5,779,071, upon a nursing bottle with an air venting structure. As can be seen therein, the double venting concept is attained through usage of a vent insert, which is a downwardly extending vent tube, and then incorporates a reservoir with a reservoir tube, that fits over the vent tube, so that when the bottle is inverted, any fluid remaining within the reservoir tube fills into the shown reservoir, and above the bottom of the inverted vent tube, when the bottle is turned, to thereby prevent the leakage of any formula to the outside, and at the same time, prevent the generation of any negative pressure within the inverted bottle, when the formula is being extracted and consumed. Similar type structure can be seen in the applicants' prior U.S. Pat. No. 5,570,796, again upon a nursing bottle with an air venting structure.

The applicants have obtained a variety of other patents upon various types of vented nursing bottles, as can be seen in their U.S. Pat. No. 8,113,365, showing a fully vented nursing bottle with single piece vent tube. Other related structures can be seen in their U.S. Pat. No. 7,828,165, in addition to Publication No. U.S. 2005/0258124, upon a fully vented wide rimmed nursing bottle with contoured vent tube. Further related structures can be seen in the patent to the inventors herein, as noted in U.S. Pat. No. 7,828,165.

As stated, the concept of this current invention is to even further reduce the number of components that make up the double venting system for a container, particularly a nursing bottle, through the integration of select related structure to the venting system when installed within particularly a nursing bottle.

Examples of other prior art showing nursing bottles, with some form of venting structure, can be seen in the Perry U.S. Pat. No. 2,061,477, which shows a form of venting structure. But, it is believed that leakage occurs when the bottle is inverted because its shown vent tube directly communicates with its lateral ports, in the region of the neck of the shown bottle.

The patent to Schwab, U.S. Pat. No. 2,156,313, shows a fairly complex form of dispensing and package device for fluids. This shows a pair of vent tubes, but it would appear when the device is inverted, whatever liquid may be contained within the shorter vent tube will be discharged, until the bottle is emptied. Another patent to Schwab, U.S. Pat. No. 2,239,275, shows a further self-contained liquid dispensing device. Apparently this device is designed to provide venting, through its complex venting structure, as can be noted, when the device is inverted, and liquid is dispensed from its tube, as can be seen.

The patent to Blackstone, U.S. Pat. No. 2,744,646, shows another form of bottle construction, that incorporates a vent tube. But, the vent tube empties directly to the outside, which means it will leak when the bottle in inverted for consumption of its contents.

The patent to Offman, U.S. Pat. No. 5,449,098, shows a fluid flow controller for a bottle. This device is apparently for use with a soda or other fluids bottle, and does have a reservoir in an effort to collect the vent tube fluids when the bottle is inverted, as shown. But, unless that bottle is oriented in a very particular direction, it will leak its fluids from the vent tube, when it is initially inverted.

The patent to Sheu, U.S. Pat. No. 5,678,710, shows another nursing bottle, and its nipple design, where it simply has a vent tube that sticks partially down into the fluids. Obviously, when that bottle is inverted, and the tip of its vent tube is within the liquid, there will be substantial leakage.

Finally, the patent to McKendry, U.S. Pat. No. 7,172,086, shows a further vented and double walled baby bottle. Apparently this device includes a check valve, to try to prevent leakage from the bottle when inverted, as during usage.

These are examples of what prior art are known, and which are designed for venting of a nursing bottle, but they are far more structurally complex of design, and obviously will have difficulty of cleaning, after usage, whereas, the concept and design of the current invention is to provide a least number of parts, to make up a double venting structure, particularly within a nursing bottle, that can be very easily be cleaned after usage, and quick to reassemble, when prepared for reception of a formula, and used by the infant during feeding and consumption of its contents.

SUMMARY OF THE INVENTION

The concept of this invention, is for use in combination with a nursing bottle, even a sports bottle, or any other fluids container, and which preferably incorporates venting in the manner of the applicants' previous patented disclosures, but is to reduce the number of operative component parts that generally make up the venting structure for the bottle, during their make up and assembly. Generally, the nursing bottle of the present invention provides a bottle which prevents the formation of a partial vacuum inside the bottle during usage and nursing, as aforesaid. Yet, the bottle of this invention uses a minimum of component parts in order to attain compound or double venting of the bottle structure, and yet in its functioning, can still resist spills. In the design and construction of the current bottle or container, because of its reduced parts, it will be much easier to clean, and does attain and prevents that formation of any partial vacuum within its operative structure, without requiring the use of any seals or gaskets, in its assembly. Moreover, the embodiment of this current invention is to provide specifically a nursing bottle, having a compound venting unit, and which is all adapted to fit inside of the nursing bottle, during its preparation for usage.

Another aspect of this invention is the provision of the fabrication of the various components for this double vented container or nursing bottle particularly with respect to the selection of the colors given to these components, and what type of hues may be exhibited when these components are assembled in combination, during usage. By way of example, if the bottle is made of a transparent material, whether it be formed of glass, blown polymer, or any other usable material for making a container or bottle, and it is tinted to a particular color, and the reservoir and its reservoir tube may be fabricated to a different coloration, when the bottle is assembled, with its double venting structure contained therein, it has been found that the separate colors may blend into a third coloration, when visually observed, as an enhancement and enticement to the user, particularly the infant and the child, when they accept formulation from the nursing bottle during usage. There are many combinations of colors as known in the art world, such as red, yellow, green, and blue, which when combined, give off a third coloration, and that concept is what is considered herein with respect to the molding of the bottle itself, and the reservoir and its reservoir tube, to take advantage of that phenomenon, in order to add to the visual effects of the nursing bottle, when it is assembled and used, and displays how a third color may be generated, from the combination of the two other colors. It is also just as likely that multiple colors may be used in the fabrication of the reservoir tube, such as to give it the appearance of a striped candy cane, or any other indicia or coloration pattern, which when located within the tinted nursing bottle, will give off many other different colors, in appearance, when viewed, during usage.

Generally, the nursing bottle of the present invention comprises a container that is adapted to hold a quantity of liquid or formula, and having an opening at its top for the reception of the nipple, the collar to hold it in place, and a double venting structure that assembles internally of the collar, with a vent tube venting to atmosphere, through the collar or lid, and a reservoir and reservoir tube that sealingly engages the vent tube, when it is assembled for usage. Thus, applicant can still attain a level of liquid trapped within the reservoir, surrounding the vent tube, as when the nursing bottle is inverted during usage. The lower portion of the reservoir tube will extend to the lower regions of the bottle, so that when it is inverted, it extends above the contained liquid line, thereby allowing the entrance of any ambient air to the upper regions of the inverted bottle, during usage, and prevent the generation of any partial vacuum at that location. The reservoir and its tube are integrally constructed, and have either an integral cap, or a cap that may snap thereon, and contains an aperture to provide for its snug and sealing fit onto the vent tube, in order to form that reservoir necessary for accumulation of any formula or liquid contained within the reservoir tube, when it is inverted with the bottle during consumption of its liquid contents. The collar and lid for the bottle has a vent aperture therethrough, and has integrally formed with it the interiorly extending short length of a vent tube, that provides for the initial entrance of ambient air into the reservoir, and then allows said air to pass through the inverted bottle, its reservoir, and the reservoir tube, to deplete or prevent the development of any vacuum at the upper regions of the inverted bottle, above any liquid contained therein, to attain that double or compound venting of the bottle, that provides the beneficial results for the infant or consumer, as previously reviewed.

These beneficial results from the double vented container or nursing bottle of this invention have long been the primary objective to be obtained from the applicants' various inventions and developments, as now patented, relating to this technology.

Thus, one of the primary objects of the present invention is to provide for and attain that compound venting of a nursing bottle from a minimum of venting components that may be quickly assembled and located within the nursing bottle, in preparation for consumption of its contents.

Another object of this invention is to provide a sports bottle that can attain that compound venting of its interior, through the use of a minimum of structure to form the double vented bottle of this invention.

A further object of this disclosure is to provide a compound vent that is proportional to the pouring aperture of the bottle or container, such that full and continuous venting will occur, and all with no aeration of the liquid, no spilling or leaking of the liquid through the vent, and to maintain ambient or positive pressure within the container, regardless of its orientation during application and usage.

A further object of this disclosure is to provide such a compound vent that supplies air to the bottom of the liquid container during removal of its contents through usage.

Still another object of this disclosure is to provide a dual vent so that no vacuum forms within the container even during usage.

A further object of this disclosure is to provide an easily assembled compound vent structure such that as liquid is removed from the container on demand there is an absence of the formation of any vacuum, or lower pressure, within its container during consumption.

Still another object of this disclosure is to provide a double venting structure that accommodates containers of various sizes and designs.

Still another object of the invention is to provide a compound vent for a nursing bottle that may be oriented in any direction and yet obtain venting of its interior to the ambient atmosphere during usage.

Still another object of this disclosure is to provide such a compound vent that may be used in any direction without spillage.

Yet a further principal object of this invention is to provide a compound venting structure for a nursing bottle that has a minimum of assembled components when prepared and readied for usage.

Yet another object of this invention is to provide a compound venting structure for a nursing bottle that contains the standard bottle and nipple, but utilizes only two other structures to attain that compound venting of its interior during consumption of its formula and liquid.

Still another object of this disclosure is to provide a two part compound vent that may be applied to a nursing bottle or other container and which may be used at any angle during consumption of its liquid contents.

Still another object of this disclosure is to provide a double vent for a container that does not introduce air bubbles into its contained liquid.

Yet another object of this disclosure is to provide such a double vent, assembled from two components, that does not form a vacuum within the bottle or container in which it locates.

Another object of this invention is to provide such a double vent that permits the readied assemble of its reservoir, to its vent tube and integral collar, formed simply of two component parts.

Another object of this disclosure is to provide a double vent that may be easily cleaned after consumption of the contents of its bottle or container.

Yet another object of this invention is to provide a double vent for a container that is simple of construction, and does not include any complex components that are difficult of assembly, or to clean after usage.

Still another beneficial object of this invention is to provide such a double vent that may be easily disassembled and thoroughly cleaned of all of its deleterious matter or generated bacteria after usage.

Another object of this invention is to provide a double vent that is made up of only two reusable parts.

Still another favorable object of the current invention is to provide a double vent that is uncomplicated to manufacture and assemble when prepared for usage within a bottle or container.

Other variations or modifications to the subject matter of this invention may be considered by those skilled in the art upon review of the disclosure as described herein, and upon undertaking a study of the description of its preferred embodiment, in view of the drawings. These, together with other objects of the disclosure, along with the various features of the structure of the double vent of this invention, are more pointed out with particularity in the claims annexed hereto, and forming a part of this disclosure. In accordance with these and other objects, the present invention will now be described with particular reference to the accompanying drawings.

DESCRIPTION OF THE PREFERRED EMBODIMENT

Figure 1:
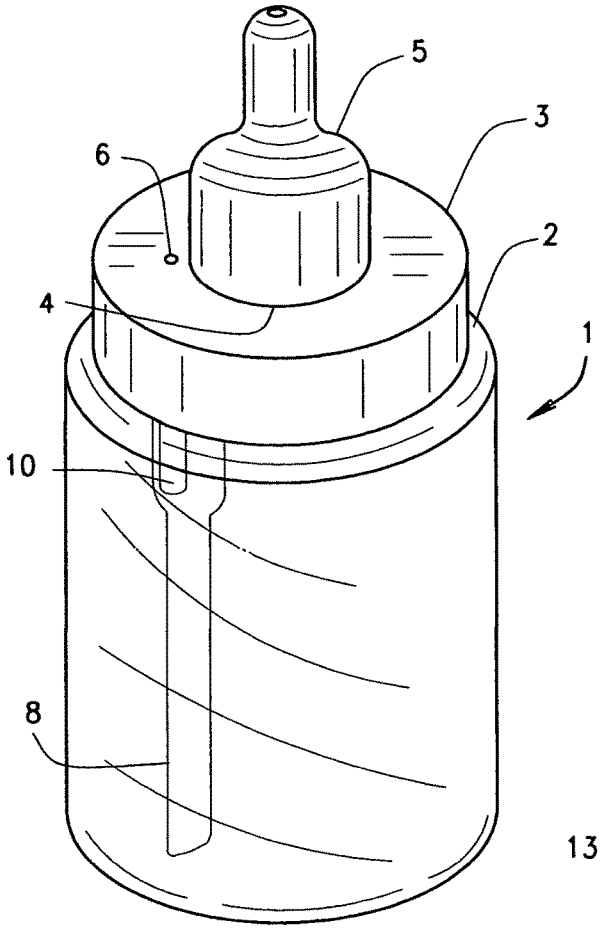
FIG. 1 is an isometric view of the singular cap compound vented nursing and related bottle of this invention.
Figure 2:
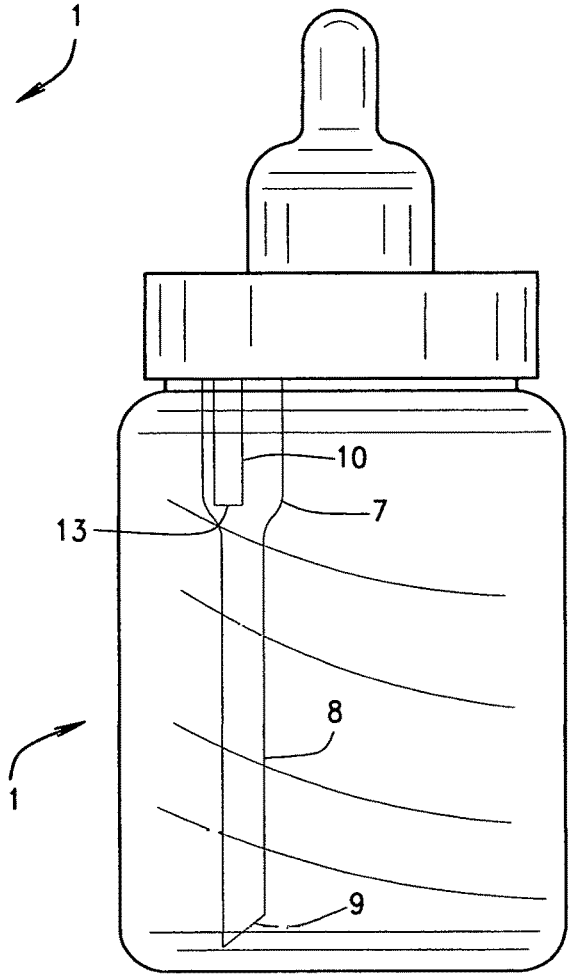
FIG. 2 is a side view of the nursing bottle.

In referring to the drawings, and in particular FIGS. 1 and 2, therein is shown the bottle or container 1 which in this particular instance may comprise a wide mouth nursing bottle, as noted. It has threads upon its upper neck portion, above 2, and a threaded collar with integral lid 3 securing thereon. Usually the lid has an aperture 4 provided therethrough, and it locates the nursing bottle nipple 5, in place. It can be seen there is an aperture port 6 provided through the lid, and this is provided for venting the interior of the nursing bottle, as will be subsequently described. It can also be seen that internally of the bottle is a reservoir 7 and a reservoir tube 8 which extends downwardly into proximity, at its slanted end 9, towards the bottom of the shown bottle. In addition, there is a vent tube 10 that is integrally formed with the lid 3, and has a passage throughout its length that communicates with the vent port 6, as previously described.

Figure 3:
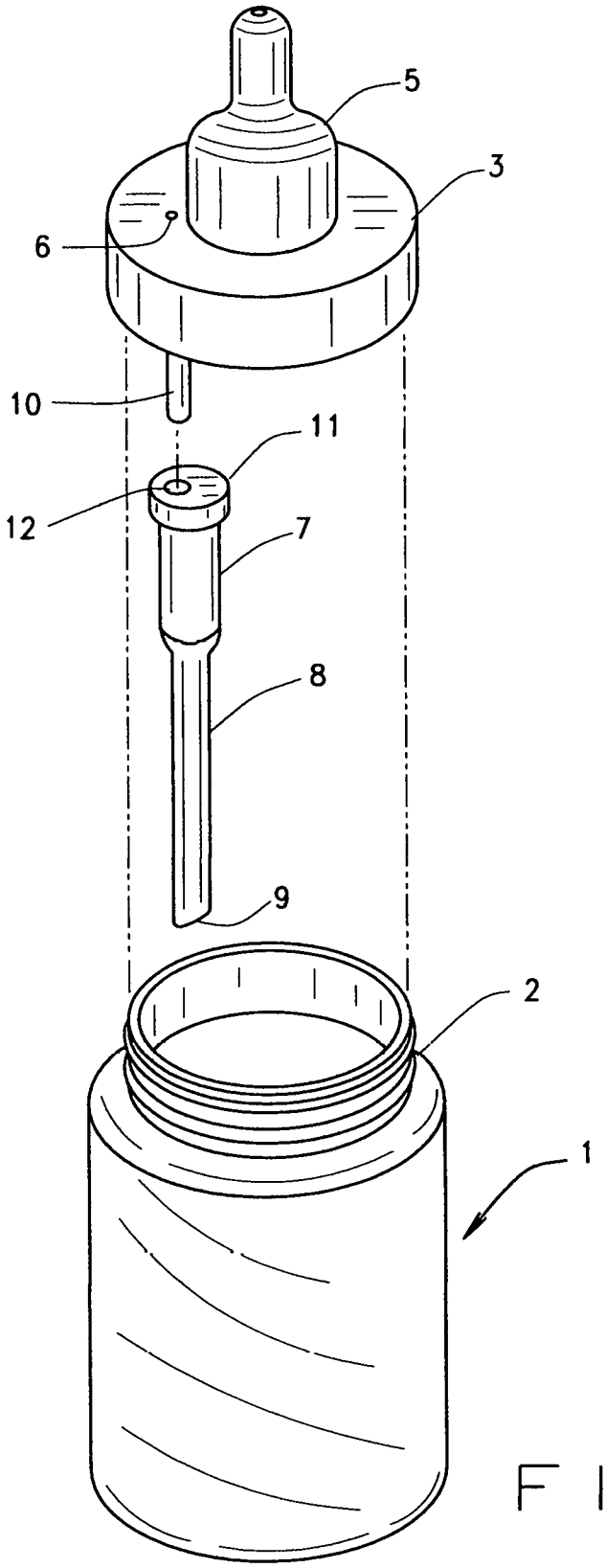
FIG. 3 is an exploded view of the bottle, its nipple and collar, and the reservoir and tube that assemble with the shown vent tube during usage.

As can be seen in FIG. 3, the reservoir 7 has an upper cap 11, and this cap may be either integrally formed or molded with the reservoir 7 and its tube 8, or it may be a separate cap that snaps into engagement upon the top of the reservoir 7, as can be understood. In any event, it is sealed into position with the reservoir, and prevents the escape of any fluid therefrom, when the cap is located in place. The cap 11 includes an aperture 12 and this aperture is of a dimension equal to or slightly lesser than the outer diameter of the vent tube 10. Since the cap 11 will be made of a more resilient type of material, whether it be rubber or a polymer, the vent tube 10 slides tightly into the cap aperture 12, as the reservoir is slid upwardly with respect to the vent tube 10, when located into position to function as a double venting structure, as noted. In other words, the vent tube 10 vents to the outside atmosphere through its port 6, and the reservoir 7, and the reservoir tube 8, allows air to pass through the same from the vent tube 10, when the nursing bottle 1 is inverted, in the manner as previously described in earlier patents relating to the subject matter of this invention. In any event, since the reservoir 7 will be slid upwardly upon the vent tube 10, the vent tube 10 extends downwardly into the reservoir 7, generally to the extent as noted at 13, in FIG. 2. Hence, when the bottle is inverted, any fluids contained within the reservoir tube 8 will flow upwardly, and be above the end 13 of the inverted vent tube 10, so as to provide a clear path for entrance of the atmosphere through the vent tube 10, through the reservoir tube 8, and to the bottom 9 of said tube, when the nursing bottle is inverted during the imbibing of its formulation by the infant.

Since the diameter of the aperture 12 of the cap 11 is of a size that it tightly embraces the vent tube 10 as it locates thereon, no leakage will occur of any formula from the reservoir 7 at the location of the aperture 12, nor will any formula enter into the reservoir, at that same location.

Thus, double venting can take place, when the nursing bottle or container is inverted, that allows for venting of the interior upper end of the inverted bottle, as feeding takes place. Thus, the child does not need to suck the formula to attain it.

While the cap 11 and the reservoir 7 are shown as two separate components, it is just as likely that these two components could be integrally molded as one piece, when forming the reservoir in the molding process, so that aside from the nursing bottle, and its nipple 5, the only other two components to the double vented container is the collar 3 and its integral vent tube 10, in addition to the reservoir 7, its integral reservoir tube 8, and its cap 11, which may all be formed as one piece. Thus, the venting structure of this invention may be of a two part assembly, which makes it easy to assemble, or to even separate after usage, and to allow for its complete cleaning, after such usage.

Figure 4:
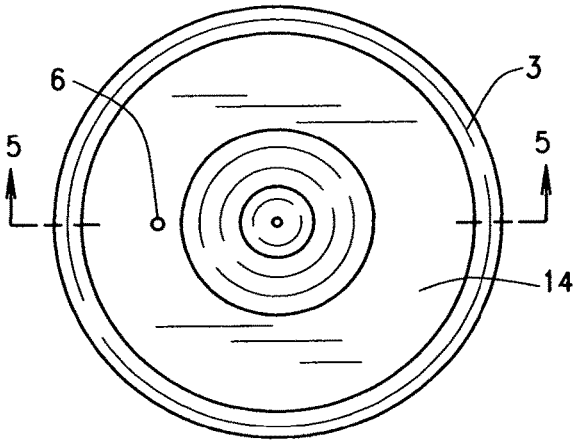
FIG. 4 is a top plan view of the integral lid and its threaded collar, holding the nursing bottle nipple in place, and the small vent aperture that is provided through the lid, as noted.
Figure 5:
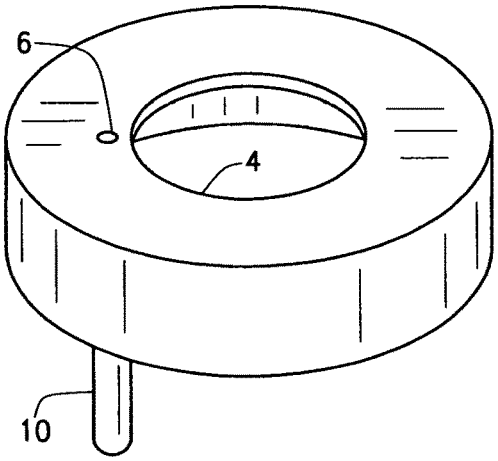
FIG. 5 is an isometric view of the integral lid, collar, and vent tube of this invention.
Figure 6:
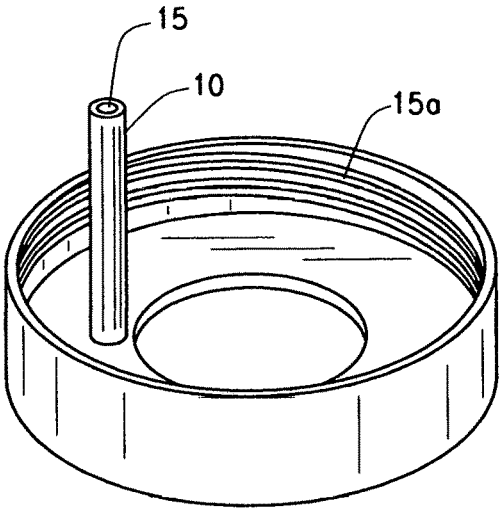
FIG. 6 is an inverted view of the integral lid, collar, and its vent tube.

The overall structure of the collar 3, its upper surface or lid 14, and its integral vent tube 10, can be readily seen in FIGS. 4, 5, and 6. In addition, as can be noted in FIG. 6, the vent tube 10 has that passage 15 provided entirely therethrough, and which opens with the port 6, to allow for venting to the atmosphere externally of the collar 3, during usage of the device. In addition, the threads 15*a* of at least the interior of the collar 3, can be readily seen in said figure. These thread onto the shown bottle.

There is another aspect of this invention which adds to the attractiveness of the container during usage, and particularly when its various components are assembled into the structure of the nursing bottle, as shown in said FIGS. 1 and 2. For example, the bottle 1 itself may be fabricated of a more transparent material, such as a molded polymer, or even formed from glass, as the usual bottle. It may be tinted to a particular coloration, in its formation. Likewise, the reservoir 7 in addition to the reservoir tube 8 may also be fabricated of a different coloration. This may be so regardless whether the reservoir tube is made transparent, or not. And, by way of example, if the bottle itself may be fabricated of one color, such as violet, and the reservoir and tube 8 are fabricated of a blue color, when the reservoir 7 and its tube 8 are located within the nursing bottle, its coloration changes to a dark purple color, which, as stated, may add to the attractiveness of the nursing bottle when it is used by the infant to see how color changes can occur, when the components are separate, but when combined together, form an entirely third coloration. There are many other colors that can be combined, as those in the art world know, such that when the color yellow is mixed with red, the color spectrum changes to orange, in their combination. Thus, this type of fabrication of the various components of this nursing bottle, and their selected individual colors, can be preplanned to provide for a visual display of a third color, which may be to the amazement and interest of the child, when they see this occur, and while utilizing the nursing bottle for feeding purposes. It is just as likely that this combination of coloration could be used in a sports bottle, and attain the same visual interest, for the user.

Figure 7:
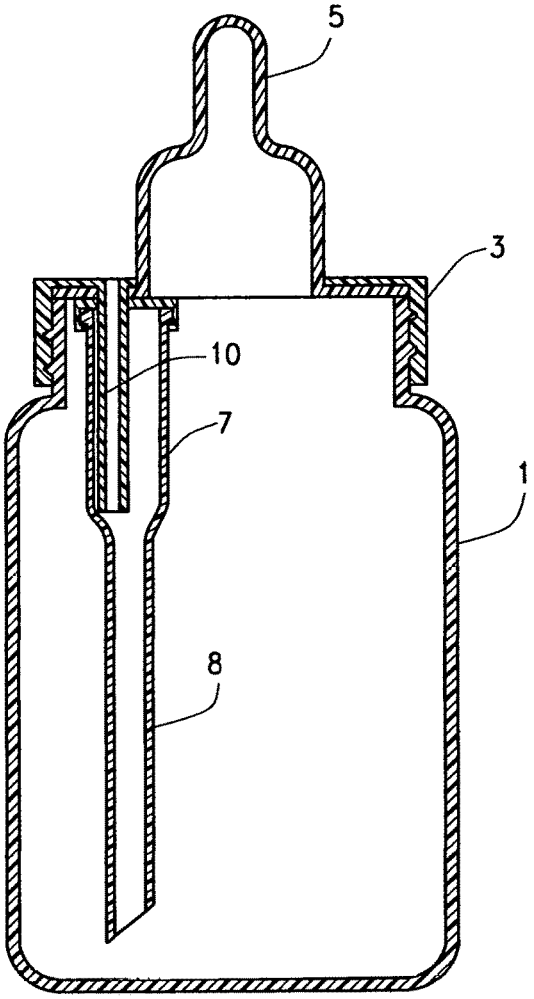
FIG. 7 shows a sectional view of the bottle, lid and collar, vent tube, nipple, and the reservoir and its tube, having a closure or cap applied to the upper end of said reservoir.
Figure 8:
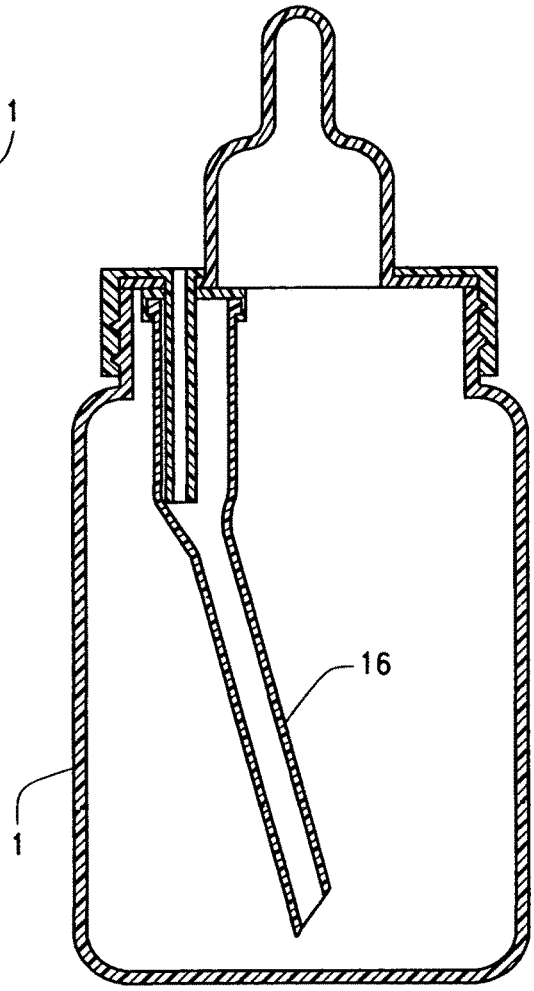
FIG. 8 shows the same structure for the nursing bottle of FIG. 7, but with its reservoir tube being canted towards the proximal bottom center of the shown bottle or container.

FIG. 7 shows the transverse sectional view of the container or nursing bottle, and its various assembled components when prepared for usage. FIG. 8 shows a similar view, of the assembled components, but shows how the reservoir tube 16 may be canted, towards the central interior bottom of the bottle 1, to assure that adequate venting is provided into the bottom of the bottle, particularly as it is inverted to any angle during usage.

Variations or modifications of the subject matter of this invention may occur to those skilled in the art upon review of the development as described herein. Such variations, if within the spirit of this invention, are intended to be encompassed within the scope of any claims to patent protection obtained upon this invention. The definition of the invention as provided in this application, their depiction in the drawings, and their description in the details of the preferred embodiment, are principally set forth for illustrative purposes only.

We claim:

1. A double vented container for use for holding a liquid, and for dispensing of the same, said container having a body portion, a neck portion, the neck portion having integral threads, a collar provided for the container, and having internal threads capable of engagement with the neck portion of said container, said container having a spout extending upwardly from the collar for use for dispensing of any liquid contained therein, a double vent operatively associated and assembled with the collar, said collar having an upper surface, a vent port provided therethrough, and an integral vent tube extending from the interior of the collar, and into the said container, and communicating with the vent port, said vent tube having a passage therethrough and in communication with the vent port of said collar, a separate reservoir, said reservoir having an integral reservoir tube extending downwardly therefrom, the upper surface of the reservoir is a separable cap, which may be secured onto or removed from the upper edge of the reservoir, during assembly and prepared for sealed reception of the vent tube therethrough, said separable cap having said aperture provided therethrough and provided for pressure fitting and sealing of said vent tube therethrough during assembly for usage, when the reservoir and separable cap are pressure fitted and sealed onto the vent tube, such that when the container holding a liquid is inverted, liquid may be dispensed from its spout, while atmospheric air may be double vented through the vent tube and said reservoir and reservoir tube into the interior of the container to prevent the generation of any vacuum therein during dispensing of its contained liquid.

2. The double vented container of claim 1, wherein said container comprises a nursing bottle.

3. The double vented nursing bottle of claim 2, wherein the spout is a nursing bottle nipple.

4. The double vented nursing bottle of claim 3, wherein the reservoir tube extends straight to the bottom of the nursing bottle in which it locates during assembly.

5. The double vented nursing bottle of claim 3, wherein the reservoir tube inclines towards the central interior bottom of the nursing bottle when assembled for usage.

6. A vented container for use for dispensing of a liquid, of claim 1, wherein said container having a body portion, said body portion being formed of transparent material, a collar provided for said container to provide for its closure, a vent tube integrally secured with the collar to provide for the venting of the interior of the container to atmosphere, particularly when inverted for dispensing of its contained liquid during usage, the transparent container as formed being tinted to a particular first color, the vent tube located within the container being tinted to another color, such that when the vent tube and tinted container are assembled for usage, a third coloration is generated for the vent tube and can be seen from the exterior of the container during its usage.

7. The vented container of claim 6, wherein said container is a vented nursing bottle.

8. The vented nursing bottle of claim 7, wherein said vented container is a double vented nursing bottle.

* * * * *